US005231958A

United States Patent [19]

Takahashi et al.

[11] Patent Number: 5,231,958

[45] Date of Patent: Aug. 3, 1993

[54] AIR/FUEL SUPPLY SYSTEM FOR A TWO-CYCLE ENGINE

[75] Inventors: Masanori Takahashi; Katsumi Torigai, both of Shizuoka, Japan

[73] Assignee: Sanshin Kogyo Kabushiki Kaisha, Shizuoka, Japan

[21] Appl. No.: 828,124

[22] Filed: Jan. 30, 1992

[30] Foreign Application Priority Data

Feb. 1, 1991 [JP] Japan ..... 3-031417
Feb. 1, 1991 [JP] Japan ..... 3-031419

[51] Int. Cl.[5] ..... F02B 75/18; F02B 33/04

[52] U.S. Cl. ..... 123/73 A; 123/73 V; 123/478

[58] Field of Search ..... 123/73 A, 73 B, 73 C, 123/52 MV, 65 R, 73 V, 476, 478; 137/855, 856

[56] References Cited

U.S. PATENT DOCUMENTS

| | | | |
|---|---|---|---|
| 4,446,833 | 5/1984 | Matsushita et al. | 123/73 A |
| 4,461,260 | 7/1984 | Nonaka et al. | 123/73 A |
| 4,993,369 | 2/1991 | Breckenfeld et al. | 123/73 A |
| 5,018,498 | 5/1991 | Hoover | 123/436 |
| 5,020,483 | 6/1991 | Watanabe | 123/73 A |
| 5,113,829 | 5/1992 | Motoyama | 123/73 A |
| 5,140,964 | 8/1992 | Torigai | 123/73 A |

*Primary Examiner*—Willis R. Wolfe
*Assistant Examiner*—M. Macy
*Attorney, Agent, or Firm*—Bacon & Thomas

[57] ABSTRACT

The air/fuel charge supplied to the cylinder rows of a V-type two-cycle engine is separately determined based on the air intake conditions associated with each of the cylinder rows. The air/fuel supply system according to the present invention promotes good mixing and misting of the fuel and air and delivers an optimal amount of fuel to each of the cylinders such that imbalances in the combustion and output of the two cylinder rows are minimized.

18 Claims, 9 Drawing Sheets

AIR/FUEL SUPPLY SYSTEM FOR A TWO-CYCLE ENGINE

BACKGROUND OF THE INVENTION

1. Field of the Invention

The present invention generally pertains to a V-type two-cycle engine and, more particularly, to an air/fuel supply system for use in a two-cycle engine.

2. Description of Prior Art

V-type two-cycle engines having first and second cylinder rows interconnected by a crankcase and separate air intake passages for each of the two cylinder rows are known in the art as represented by published Japanese patent application HEI 2-248628. In this known two-cycle engine arrangement, the air intake passages supplying the cylinder rows are angled inward toward the center of the crankcase. The crankcase defines a crank chamber within which a crankshaft rotates. The air intake passages supplying the cylinder rows in this known arrangement are connected to the crank chamber. Because of this, a swirling flow is created within the crank chamber due to the rotation of the crank shaft. This swirling effect tends to obstruct air flow from some of the intake passages which creates non-uniform intake air flows to the corresponding cylinder rows.

In addition, it is also known to utilize a fuel injection system in combination with a two-cycle engine having an air intake passage as described above. In such an arrangement, it has been known to supply fuel to all the cylinders at the same fuel pressure through the air intake passages. Due to the swirling flow created within the crank chamber as discussed above, a differential pressure is created within the air intake passages for each of the cylinder rows. This pressure differential also tends to create a difference in the fuel pressure between the two cylinder rows. When the mount of fuel injected is determined by the pressure differential between the fuel pressure and the negative air intake pressure, it has been found that a disparity in the amount of fuel received by each cylinder row is encountered. This disparity results in an imbalance in combustion and output between the two cylinder rows.

Therefore, there exists a need in the art for an air/fuel supply system which can supply an air/fuel mixture to respective cylinder rows of a V-type two-cycle engine which would eliminate imbalances between the two cylinder rows so as to prevent combustion and output variations.

SUMMARY OF THE INVENTION

The present invention has as its object the improvement of providing a V-type two-cycle engine with an air/fuel supply system which can balance the combustion and output between two cylinder rows. This objective is realized by the present invention by providing a two-cycle engine having a cylinder block with two rows of cylinders in a V-configuration with air intake passages for each row of cylinders located approximately symmetrically on either side of the engine crankshaft and wherein the air/fuel supply to each of the cylinder rows are separately controlled and means are provided to promote the misting of fuel for both cylinder rows.

More particularly, in accordance with one aspect of the invention, each of the air intake passages includes a reed valve which is mounted over an opening in a reed valve holder assembly. The reed valve holder assembly is substantially V-shaped in cross-section thereby defining first and second legs that converge toward the downstream direction of intake air flow. The first leg of each reed valve holder assembly is longer than the second leg and has the reed valve secured thereto. At least one fuel injector unit opens into each intake air passage on a side substantially opposing this longer, first leg such that the fuel is sprayed toward the first leg which enhances fuel misting.

According to another aspect of the invention, a fuel control supply system is provided which determines the optimum fuel to be supplied for each row of cylinders separately. The fuel control system determines the separate fuel supply amounts based on various sensed parameters characteristic of air intake conditions.

These and other objects of the present invention will become more readily apparent from the following detailed description of preferred embodiments thereof, when taken in conjunction with the drawings wherein like reference characters refer to corresponding parts in the several views.

DETAILED DESCRIPTION OF THE PREFERRED EMBODIMENTS

Figure 1:
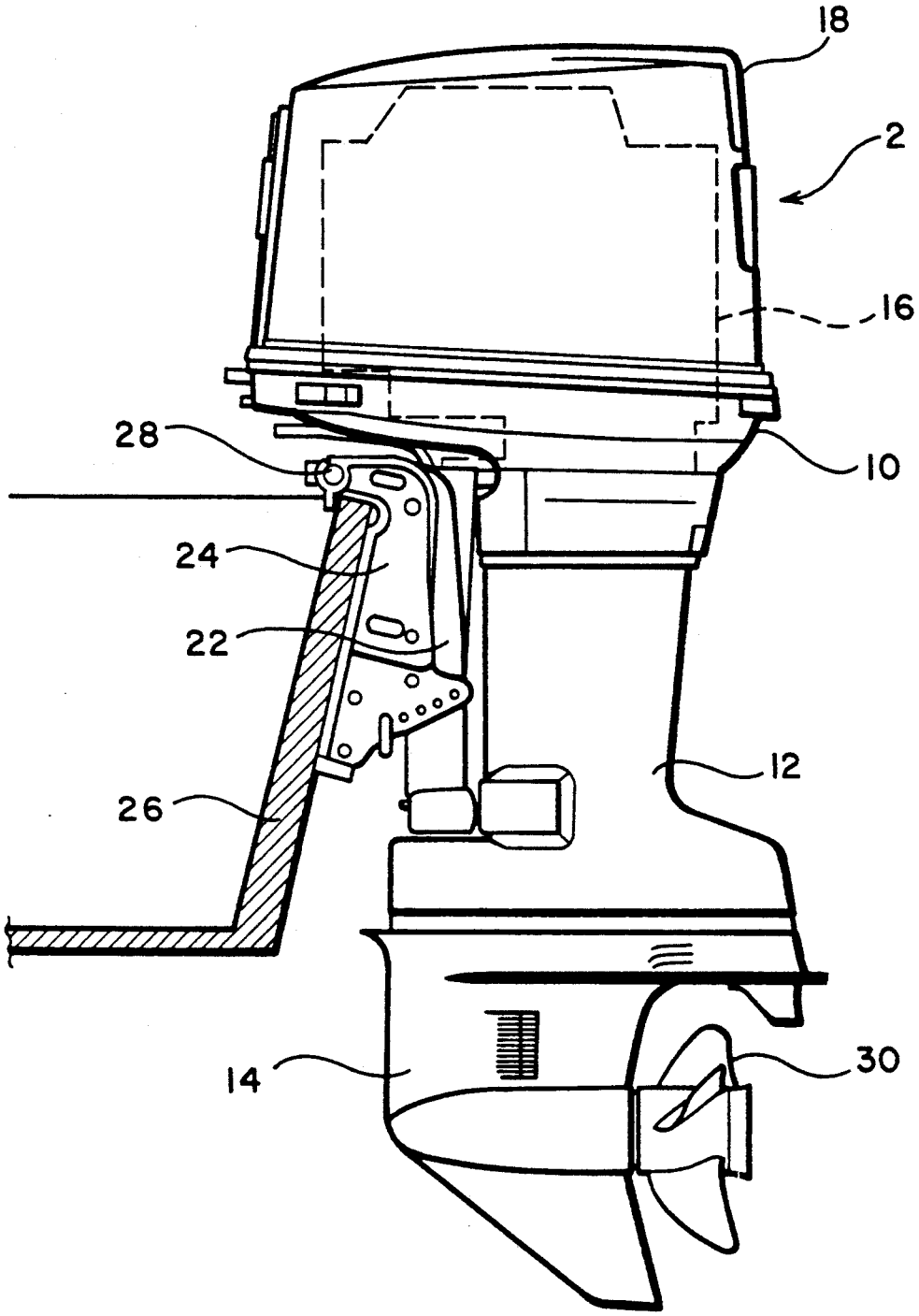
FIG. 1 depicts a side elevation view of a boat mounted marine outboard motor incorporating the engine arrangement of the present invention.

With initial reference to FIG. 1, a marine outboard engine unit incorporating the present invention is generally indicated at 2. Marine outboard engine unit 2 includes a bottom cowling 10, an upper casing 12 and a lower casing 14. Secured to bottom cowling 10 is a V-type two-cycle engine 16. In the preferred embodiment, engine 16 includes two cylinder rows each having three cylinders. Secured to bottom cowling 10 and covering engine 16 is an upper cowling 18. Outboard engine unit 2 is also equipped with a swivel bracket 22 which is pivotable relative to a clamp bracket 24 adapted to be secured to a transom 26 of a boat. Swivel bracket 22 defines a substantially upright axis about which outboard engine unit 2 may be rotated for steering purposes. In addition, swivel bracket 22 is pivotally attached to clamp bracket 24 through tilt shaft 28 which extends in a substantially horizontal direction, transverse with respect to the steering axis of outboard engine unit 2. As is known in the art, tilt shaft 28 permits outboard engine unit 2 to be pivoted thereabout in order to raise or lower outboard engine unit 2 relative to transom 26. As is also known in the art, outboard engine unit 2 includes a propeller 30 which is drivingly connected to an output shaft of engine 16.

Figure 2:
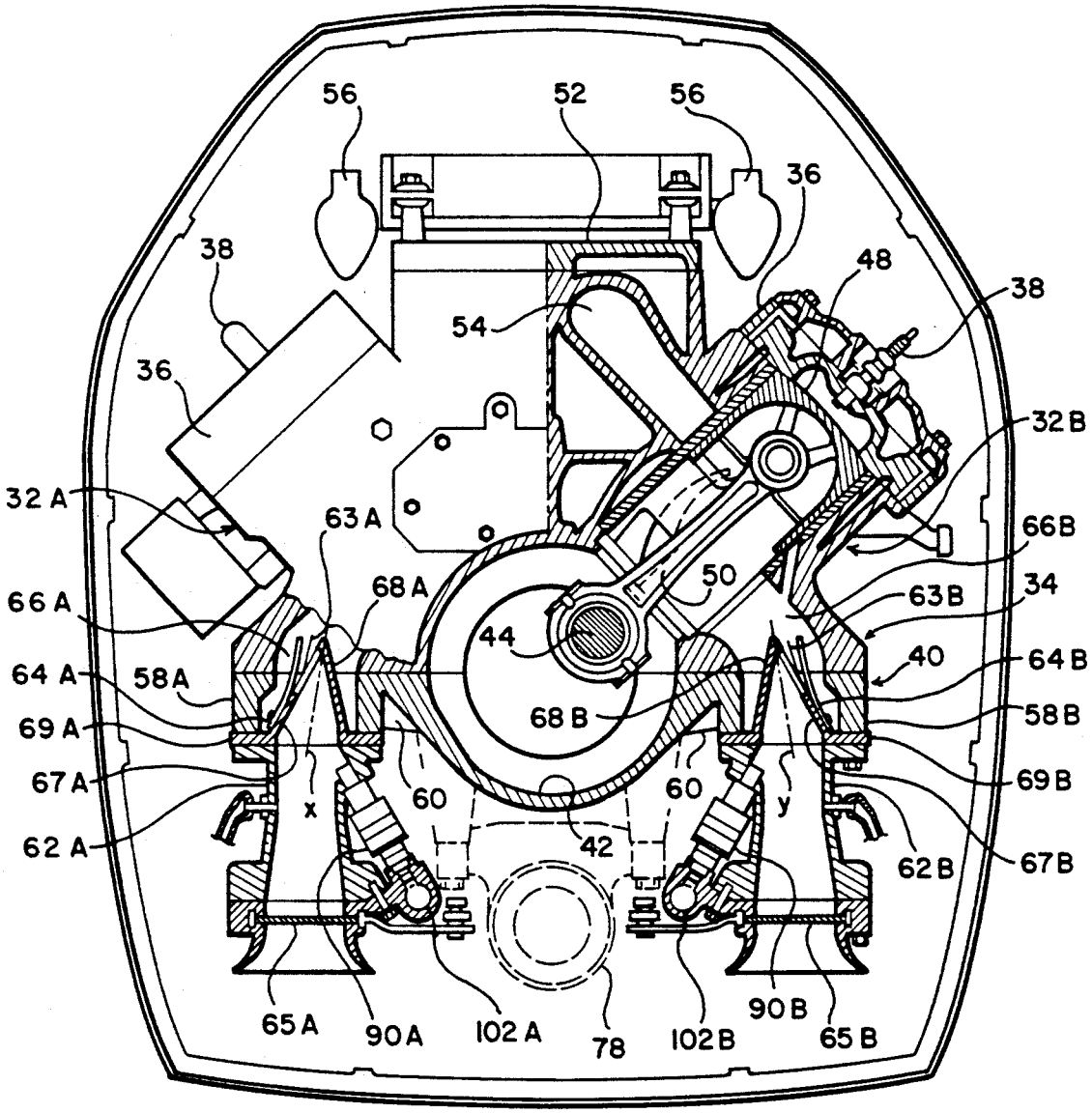
FIG. 2 is a partial cross-sectional top view of the engine shown in FIG. 1 depicting a first embodiment of the air/fuel supply system of the present invention.

With reference to FIG. 2, a detailed description of engine 16 along with a first embodiment of the air intake passage arrangement of the present invention will be described. As previously discussed, engine 16 includes two rows of cylinders respectively indicated at 32A and 32B. Cylinders 32A and 32B share a common cylinder block 34, which together define a V-configuration. Each of the cylinder rows 32A, 32B are generally symmetrical and include a cylinder head 36 having apertures (not labeled) for spark plugs 38.

Engine 16 further includes a crankcase 40 which is attached to cylinder block 34 such that a crank chamber 42 is formed therebetween. Located within crank chamber 42 is a vertically disposed crankshaft 44. Crankshaft 44 is connected to a piston 48 located within each cylinder of cylinder rows 32A and 32B by means of respective writs pins (not numbered) and connecting rods 50.

Between cylinder rows 32A and 32B of engine 16 is an exhaust cooling plate 52. An exhaust passage 54 is formed as part of engine 16 between exhaust cooling plate 52 and each cylinder row of cylinder block 34 (only one exhaust passage 54 being shown in FIG. 2). Exhaust gases entering exhaust passage 54 are conducted through an exhaust expansion chamber (not shown) to lower casing 14 where they are expelled. In the preferred embodiment, exhaust cooling plate 52 is cooled by engine coolant and has ignition coils 56 for spark plugs 38 mounted thereon.

In general, all of the structure shown and described with reference to FIGS. 1 and 2 up to this point are known in the art. Particular reference will now be made to portions of FIG. 2 in describing the unique air/fuel supply system of the present invention. The air/fuel supply arrangements for the two cylinder rows 32A, 32B are located on opposite sides of crankshaft 44 in a roughly symmetrical configuration. The air/fuel supply arrangement includes air intake tubes 58A, 58B which are formed integral with crankcase 40. Air intake tubes 58A, 58B are reinforced by means of ribs 60 which extend between air intake tubes 58A, 58B and crank chamber 42 and serve to increase the overall strength of crankcase 40, especially the strength opposing bending in a direction defined by the axis of crankshaft 44.

Fixed secured to crankcase 40 are a pair of symmetrically arranged throttle bodies 62A, 62B which are in fluid communication with respective air intake tubes 58A, 58B via reed valves 63A and 63B, respectively. Reed valves 33A and 33B are secured to respective reed valve holder assemblies 64A, 64B as will be discussed more fully below. In addition, shutter type throttle valves 65A, 65B are provided to regulate air intake as well as discussed more fully below. Air intake tubes 58A, 58B are further connected to crank chamber 42 by means of air intake passages 66A and 66B formed in cylinder block 34.

Each of the reed valve holder assemblies 64A, 64B has an asymmetrical V-shaped cross section and includes a first leg 67A, 67B and a second leg 68A, 68B. As clearly evident from viewing FIG. 2, first legs 67A, 67B are longer than second legs 68A, 68B. In addition, reed valve holder assemblies 64A, 64B include an integral flange portion 69A, 69B which is interposed between the connection of throttle body 62A, 62B and crankcase 40.

Figure 3:
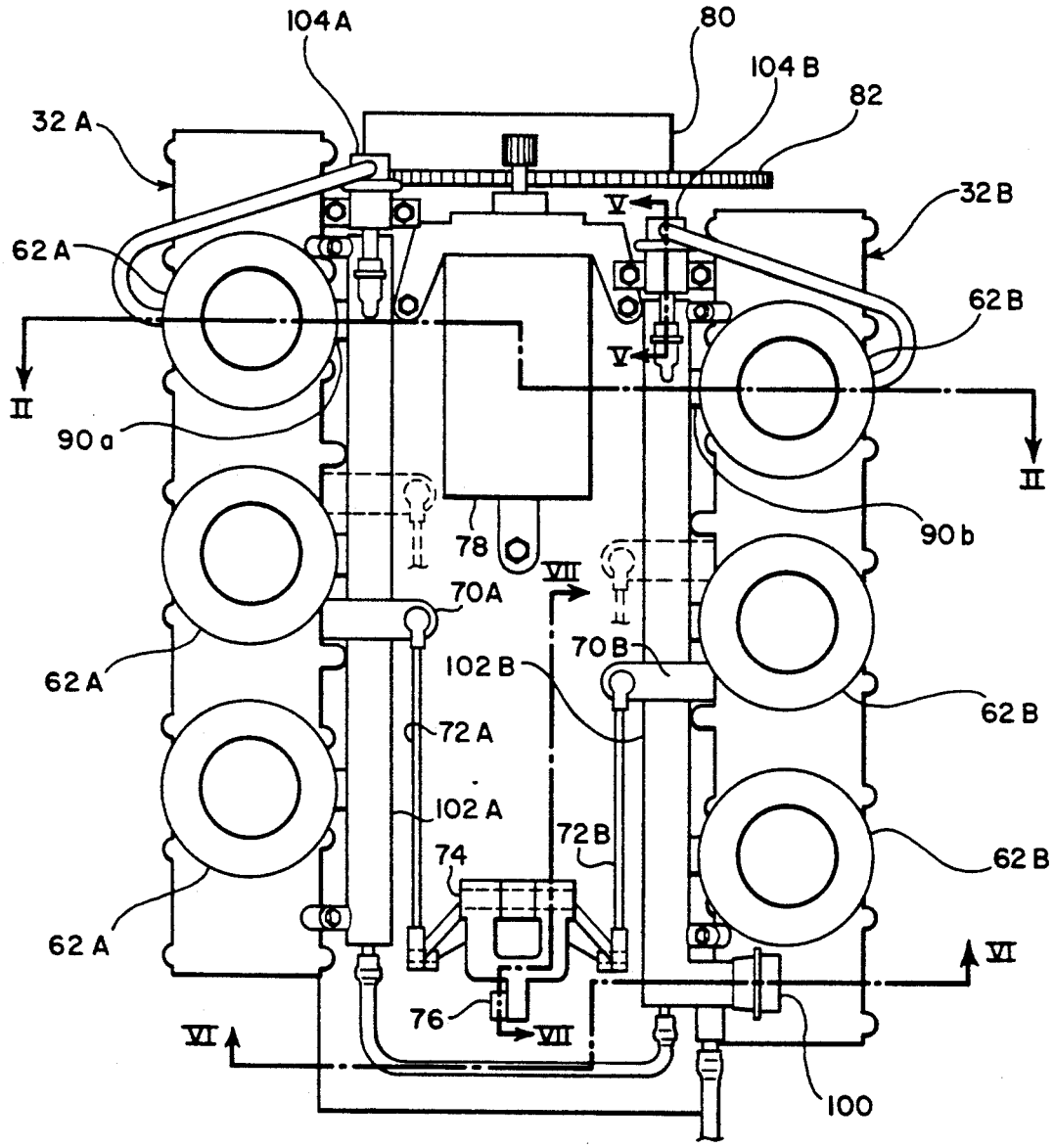
FIG. 3 is a front elevation view of the engine incorporated in the boat mounted marine outboard motor shown in FIG. 1.
Figure 4:
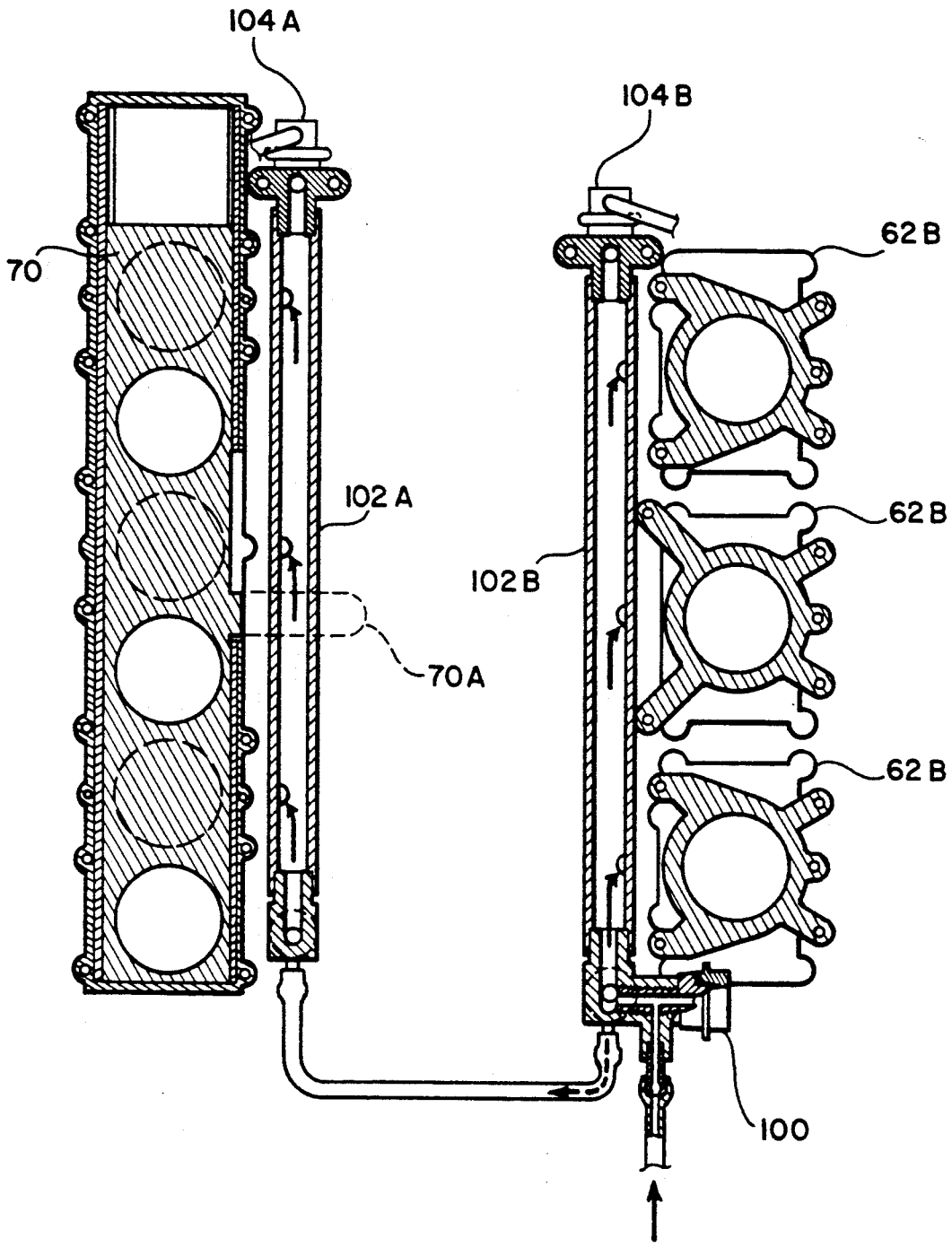
FIG. 4 is a cross-sectional view of the fuel passage system incorporated in the engine in shown FIG. 3.
Figure 5:
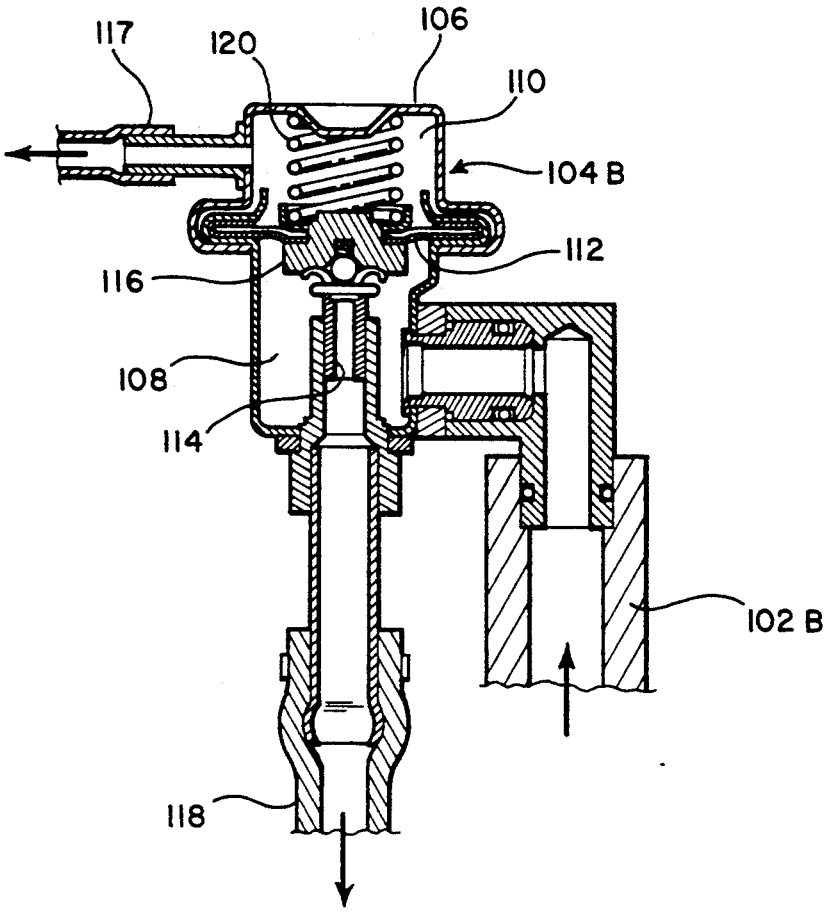
FIG. 5 is a partial, cross-sectional view taken along lines V—V in FIG. 3.
Figure 6:
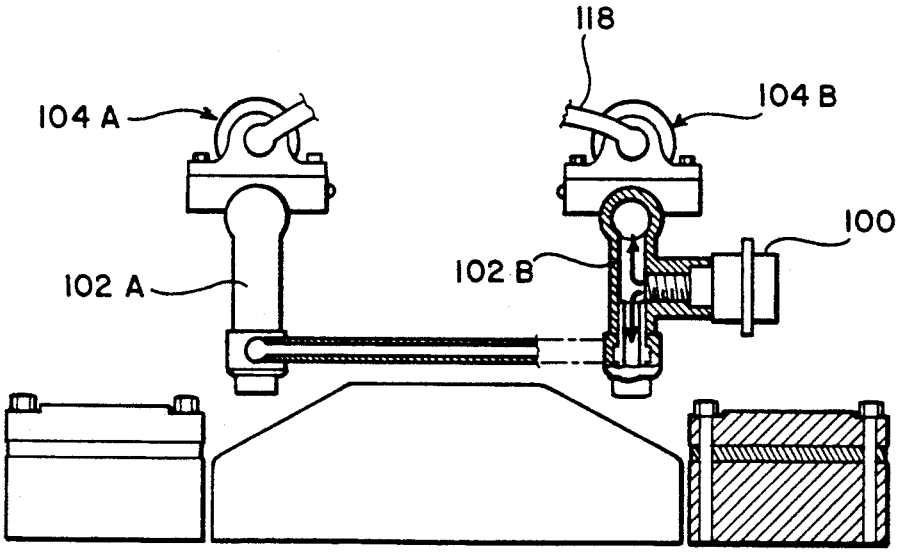
FIG. 6 is a partial, cross-sectional view taken along lines VI—VI in FIG. 3.
Figure 7:
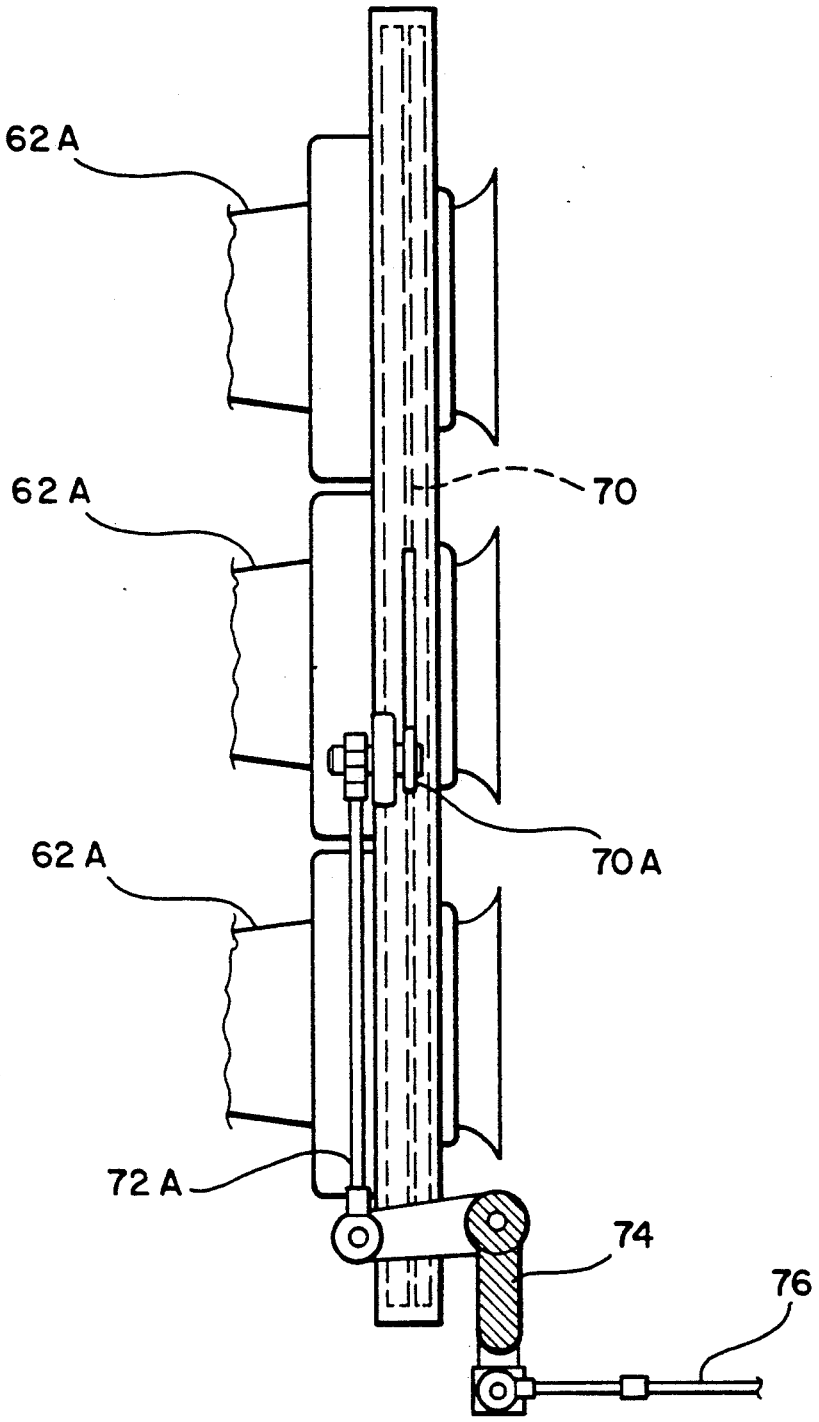
FIG. 7 is a partial, cross-sectional view taken along lines VII—VII in FIG. 3.

As previously stated, the intake end of throttle body 62A, 62B include shutter type throttle valves 65A, 65B which slide up and down to regulate the amount of intake air. Since, in general, throttle valve 65A, 65B open and close in synchronization with the cylinders, six of which are provided in the preferred embodiment, there are three throttle valves 65A, 65B for each of the two cylinder rows 32A, 32B. With reference to FIGS. 3 and 4, the three throttle valves 65A, 65B for each of the two cylinder rows 32A, 32B are formed on a common valve plate 70 (only one of which is shown in FIG. 4). The two valve plates 70 each have respective arms 70A, 70B which are linked through rods 72A, 72B to a bell crank assembly 74. By this arrangement, sliding movement of the valve plates 70 causes a throttle wire 76 to move up and down by means of the connection through links 72A, 72B and bell crank 74. Valve plate 70 has openings (not labeled) which correspond to each of the throttle bodies 62A, 62B such that the movement of these openings by sliding valve plate 70 controls the surface area of the air intake passage as best represented in FIG. 4.

In addition, a starter motor 78 is attached to crankcase 40 between throttle body 62A and 62B along with a flywheel magnet 80. A pinion (not labeled) of starter motor 78 is adapted to engage a ring gear 82 of flywheel magnet 80 for starting of engine 16. As is known in the art, ring gear 82 is attached to an upper end of crankshaft 44 for this purpose.

The fuel system utilized in the air/fuel supply arrangement of the present invention will now be described. In the embodiment shown in FIG. 2, fuel injection valve units 90A, 90B are respectively secured to throttle body 62A, 62B on a side thereof substantially opposing the longer, first legs 67A, 67B of reed valve holder assemblies 64A, 64B. Of course, reed valves 63A, 63B extend over openings (not labeled) in first legs 67A, 67B which permit the air/fuel mixture to flow through throttle body 62A, 62B and into intake passages 66A, 66B, respectively. In the preferred embodiment shown, there are no corresponding openings in the shorter, second legs 68A, 68B such that all of the intake air/fuel mixture passes through the openings in first legs 67A, 67B. Although the fuel injection control system will be discussed further below, at this point it should be noted that the air intake pressure for the starboard side cylinder row 32A is detected through a pressure sensor in throttle body 62A in order to control the amount of fuel injected through fuel injection unit 90A. Similarly, the air intake condition of the port side cylinder row 32B is determined based on the negative pressure in throttle body 62B in order to control the amount of fuel injected from fuel injection unit 90B. Therefore, in general, it can be seen that the amount of fuel injection, i.e. the fuel injection pressure, is determined by the negative air intake pressure.

Figure 9:
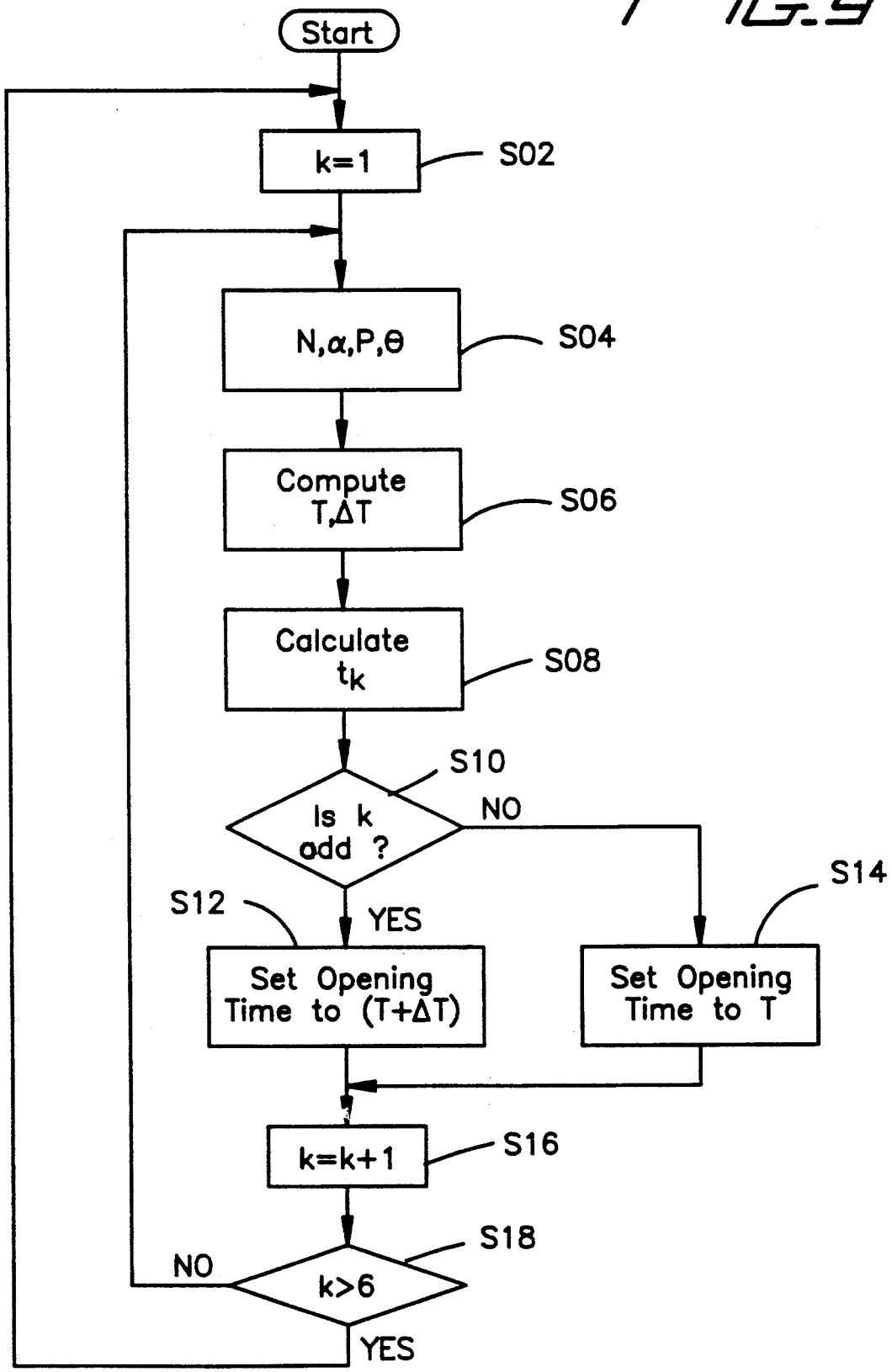
FIG. 9 depicts a computer flowchart for use in controlling the fuel injectors in the air/fuel supply system of the present invention.

With specific reference to FIGS. 3–7 and portions of FIG. 9, the fuel supply system of the present invention will now be described in more detail, With initial reference to FIG. 9, fuel is delivered to outboard engine unit 16 from a tank 92 by a pressure pump (not shown). This fuel is sent, via a filter 94 and accumulator 96, to a fuel pump 98. Fuel pump 98 is mechanically driven by engine 16 as is known in the art. Pressure variations in the fuel exiting fuel pump 98 are eliminated in accumulator 100 and then the fuel passes into the bottom of distribution branch lines 102A and 102B mounted respectively for each cylinder row 32A, 32B. Branch lines 102A and 102B are respectively connected to fuel injection units 90A, 90B for each cylinder.

Adjustment valves 104A, 104B are located at the upper end of branch lines 102A, 102B. Since adjustment valves 104A and 104B are identical, particular reference will now be made to FIG. 5 in describing the adjustment valve 104B. Pressure adjustment valve 104B functions to control the fuel pressure and includes an outer casing 106 which separates a fuel chamber 108 from an air chamber 110. Located within case 106 is a diaphragm 112 which includes a valve port 114 and a valve body 116 which can shift to positions for opening and closing the flow through valve port 114. As shown, fuel chamber 108 is connected to distribution branch line 102B. The negative air intake pressure from throttle body 62B on the port cylinder row 32B is conveyed to air chamber 110 through a conduit 117 and valve port 114 is connected to a return pipe 118. A coil spring 120 is located within casing 106 and aids in balancing the pressure on either side of diaphragm 112. During operation of engine 16, increases and decreases in the negative intake air pressure will be experienced which will affect the fuel pressure inside the branch lines 102A and 102B. As previously stated, the pressure adjustment valve 104A of starboard side cylinder row 32A is of similar construction, the only difference is that the negative air intake pressure associated with throttle body 62A for the starboard side cylinder row 32A is guided to the corresponding air chamber 110.

As can be readily seen from the above description, the negative air intake pressure from each of the cylinder rows 32A, 32B is separately directed from the respective distribution lines 102A, 102B to the pressure adjustment valves 104A, 104B so that the fuel pressure supplied to cylinder rows 32A and 32B are separately established. Since there is a difference in the air intake conditions for the two cylinder rows 32A and 32B depending upon the direction of the crankshaft rotation, their respective pressure control valves 104A, 104B may be individually set to cause optimum combustion conditions at each cylinder. This arrangement allows the imbalance in the output from the cylinders to be minimized. In addition, due to the swirl flow inside the crank chamber, if the negative air intake pressure on the starboard side cylinder row 32A increases, then the fuel pressure from injection valve unit 90A will drop to prevent an excess of fuel from being injected. On the other hand, if the intake pressure on the port side drops off, then fuel pressure will be increases to prevent an insufficient amount of fuel injection.

In the above-described embodiment, the fuel pressure to each cylinder row was changed depending upon the negative air intake pressure experienced by that row. The fuel supply control means comprised the pressure control valves 104A and 104B which can alter this fuel pressure. It is possible, however, to also utilize other fuel supply arrangements. For example, controlling the amount of fuel could be accomplished for the cylinder rows by changing the time the fuel injector units are open. A preferred embodiment according to this type of fuel control means will now be described with particular reference to FIGS. 8 and 9.

Figure 8:
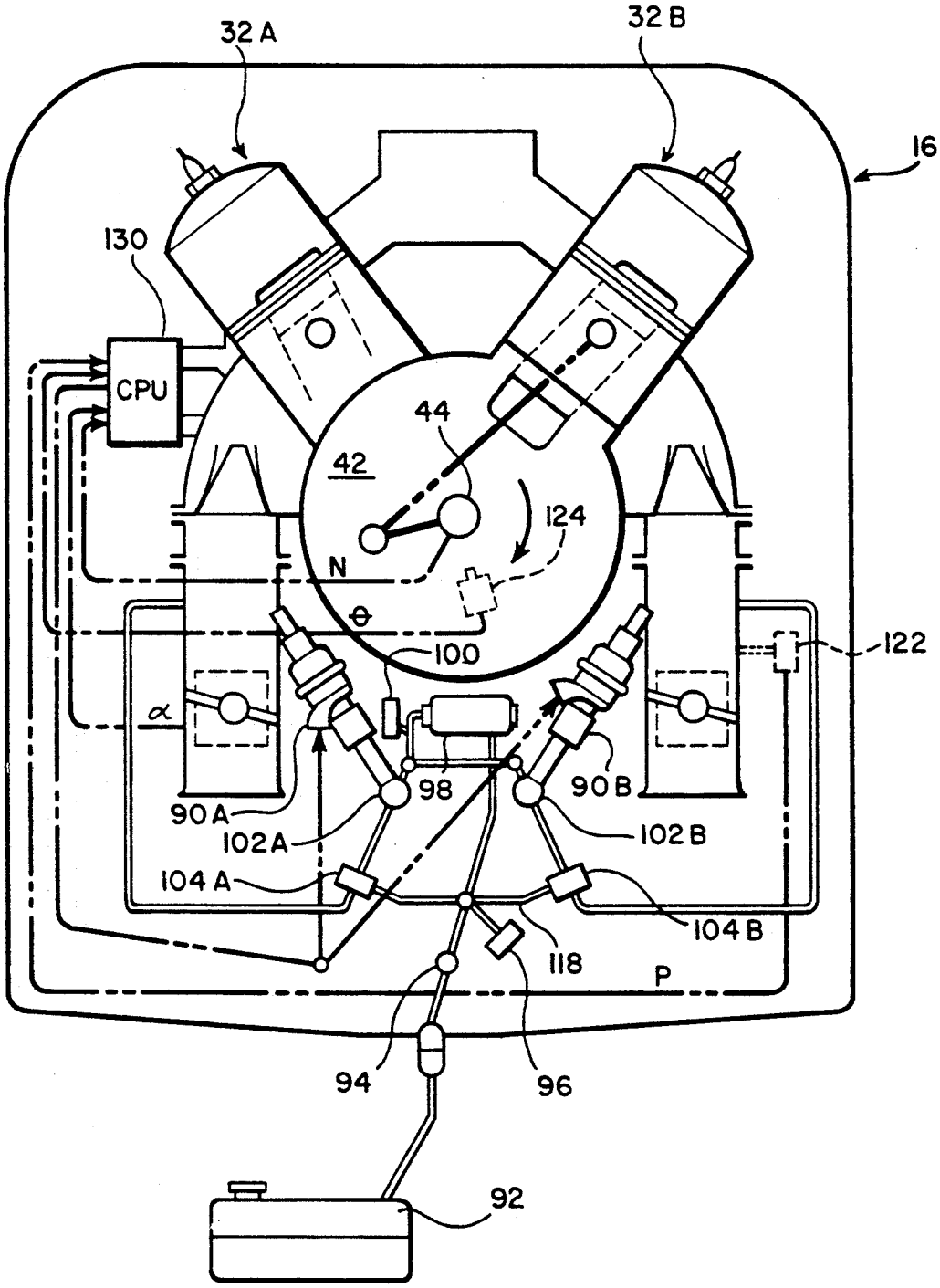
FIG. 8 shows a partial cross-sectional top view similar to that shown in FIG. 2 but depicting a second air/fuel supply system embodiment according to the present invention.

The engine arrangement shown in FIG. 8 is generally analogous to that shown in FIG. 2 and described above with the exception that slide valves 65A and 65B, described with reference to the FIG. 2 embodiment, have been replaced by rotary throttle valves (not labeled). It should be readily understood, however, that both type of valve arrangements are applicable. In FIG. 8, the fuel control system is controlled by means of a microcomputer 130 (hereinafter designated "CPU"). CPU 130 determines the optimal opening time for each of the fuel injection valves based on various sensed engine parameters as detailed below.

Signals inputted to CPU 130 are outputted by a speed sensor (not labeled) which outputs signals indicative of a rotational velocity N of crankshaft 44, an angle sensor (not labeled) which senses the degree of opening $\alpha$ of the throttle valves, a pressure sensor 122 which senses the negative air intake pressure p, and an angle sensor 124 which determines the position $\theta$ of crankshaft 44. The specific crankshaft construction of the CPU and sensors is not provided herein since various known commercial embodiments are readily available and known in the art. CPU 130 computes the optimum fuel injection time for each of the cylinder rows 32A, 32B by a method which will now be described with reference to FIG. 9.

CPU 130 first causes the cylinder to be injected with fuel by setting a constant k equal to 1 in step SO2. CPU 130 then reads all of the above mentioned input signals N, $\alpha$, p, and $\theta$ (step SO4). In the next step, CPU 130 determines the opening time of the corresponding fuel injection valve, e.g. fuel injection valve 90A of cylinder row 32A on the starboard side, as T and the opening time for the other fuel injection valve unit 90B on the port cylinder 32B as $T+\Delta T$ (step SO6). This computation takes place while reading from the memory data (ROM) which would indicate the optimal valve opening time for the current operating condition.

Next, CPU 130, based upon the crankshaft position signal $\theta$, determines the valve opening timing $t_k$ for the fuel injection valve unit corresponding to cylinder k. CPU 130 then determines whether k is even or odd, in other words, whether the cylinder is on the port cylinder row 32A or the starboard cylinder row 32B (step S10). If k is odd, (the cylinder is on the starboard side 32A) then the opening time ($T+\Delta T$) is used in step S12. If the k value is even, then the opening time is set to T (step S14) for the port cylinder row 32A. CPU then increments k by 1 and repeats the same operation for the next cylinder (back to step SO6) unit it reaches the last cylinder (6 in the preferred embodiment) when k is returned to 1 and the whole process is repeated (step S18).

Figure 10:
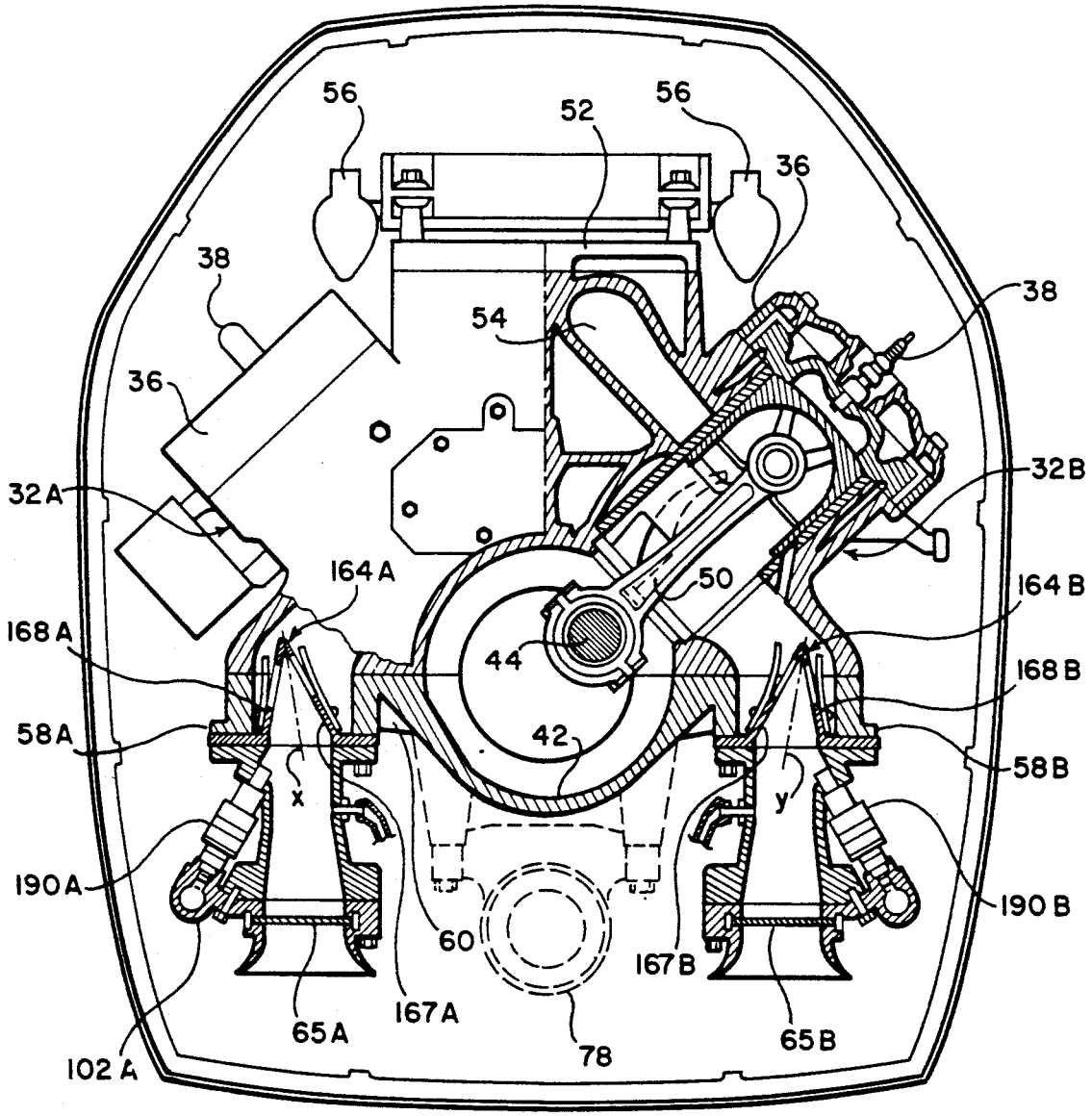
FIG. 10 is a partial, cross-sectional top view similar to that shown in FIG. 2 but depicting a third embodiment of the air/fuel supply system of the present invention.

A brief reference will now be made to the alternate embodiment shown in FIG. 10 which depicts a similar cross section to that shown in FIG. 2 but which includes reed valve holder assemblies 164A, 164B which are angled outwardly with respect to crankshaft 44. Therefore, in this embodiment, the longer, first leg 167A, 167B of each reed valve holder assembly is located closer to crankshaft 44 than second legs 168A and 168B. Due to this arrangement, fuel injector valve units 190A, 190B are located on the opposite side of the throttle bodies than described with reference to FIG. 2 in order to still maintain the positioning of fuel injector valve units 190A, 190B relative to first legs 167A, 167B.

Also, the FIG. 8 embodiment exemplifies that openings can be provided in each of the legs of reed valve holder assemblies 164A and 164B along with a corresponding reed valve without departing from the spirit of the present invention. The fuel supply control system for use in the FIG. 10 embodiment may take the form of either of the systems described above.

By the above description, it can readily be seen that each of the embodiments described employs reed valves and reed valve holders which have an asymmetrical V-shape in cross-section and wherein the fuel injector valve units are directed at the longer leg side of the reed valve holders where a higher amount of intake air passes. This arrangement promotes good mixing and misting of the fuel and air and minimizes imbalances in the combustion and output of the two cylinder rows. In addition, additional combustion imbalances are controlled by determining the fuel supply to each of the cylinder rows separately. This eliminates imbalances in the combustion and output between the two cylinder rows caused by the variation in air intake condition resulting from the crankshaft rotation.

Although described with reference to particular embodiments of the invention, it should be recognized that various changes and/or modifications can be made to the embodiments described above without departing from the spirit and scope of the present invention as defined in the following claims.

We claim:

1. An air/fuel supply system for use in a V-type two-cycle engine having first and second cylinder rows interconnected by a crankcase, first and second air intake passages having throttle valves for supplying air to the first and second cylinder rows respectively and a crankshaft rotatably mounted within a crank chamber open to said intake passages, said air/fuel supply system comprising:

at least one reed valve for controlling the passage of air from each air intake passage to its corresponding cylinder row;

a reed valve holder assembly for each of said reed valves, each of said reed valve holder assemblies being substantially V-shaped in cross-section and having first and second legs that converge toward the downstream direction of intake air flow, said first leg of said reed valve holder assembly being longer than said second leg and including an aperture therethrough, said at least one reed valve being secured to said first leg and extending over said aperture on the downstream side thereof; and at least one fuel injector unit opening into the air intake passage for each of said first and second cylinder rows, said at least one fuel injector unit opening into the air intake passage on a side substantially opposing said first leg of said reed valve holder assembly such that fuel is sprayed by said fuel injector unit toward said first leg.

2. An air/fuel system as claimed in claim 1, wherein said reed valve holder assemblies are angled toward the crankshaft with said second leg of each said reed valve holder assemblies being located closer to the crankshaft then said first leg.

3. An air/fuel supply system as claimed in claim 1, wherein said reed valve holder assemblies are angled away from the crankshaft with said first leg of each of said reed valve holder assemblies being located closer to the crankshaft than said second leg.

4. An air/fuel supply system as claimed in claim 1, wherein each of said reed valve holder assemblies include annular flanges for securing said reed valve holder assemblies to the crankcase.

5. An air/fuel supply system as claimed in claim 1, further comprising means for controlling the amount of fuel injected by said at least one fuel injector unit for each of said first and second cylinder rows separately.

6. An air/fuel supply system as claimed in claim 5, wherein said controlling means is responsive to the air intake pressure in a respective air intake passage to control the amount of fuel injected therein.

7. An air/fuel supply system as claimed in claim 6, wherein said controlling means includes engine parameter sensors having outputs indicative of an operating condition of said engine and said controlling means determines the amount of fuel injected based on said sensor output signals received from said sensors.

8. An air/fuel supply system as claimed in claim 7, wherein said sensors include a speed sensor for outputting signals indicative of the rotational velocity of the crankshaft, an angle sensor for sensing the degree of opening of each throttle valve and a pressure sensor for sensing the air intake pressure in each of the intake passages.

9. An air/fuel supply system as claimed in claim 8, further including a position sensor for sensing the position of the crankshaft.

10. An air/fuel supply system for use in a V-type two-cycle engine having first and second cylinder rows interconnected by a crankcase, first and second air intake passages having throttle valves for supplying air to the first and second cylinder rows respectively and a crankshaft rotatably mounted within a crank chamber open to said intake passages, said air/fuel supply system comprising:

at least one fuel supply unit opening into the air intake passage for each of said first and second cylinder rows;

means for sensing the air intake pressure in said first and second air intake passages; and means for controlling the amount of fuel supplied by said at least one fuel supply unit or each of said first and second cylinder rows separately based on the sensed air intake pressure in a respective one of said first and second intake passages.

11. An air/fuel supply system as claimed in claim 10, further comprising:

means for sensing a rotational velocity of the crankshaft; and means for sensing the degree of opening of the throttle valves, said controlling means being responsive to each of said sensing means for determining the amount of fuel supplied to each cylinder row.

12. An air/fuel supply system as claimed in claim 11, further comprising means for sensing the position of the crankshaft, said controlling means being further responsive to said crankshaft position sensing means for timing the supply of fuel to the respective cylinder rows.

13. An air/fuel supply system as claimed in claim 10, wherein said at least one fuel supply unit comprises at least one fuel injector unit for each of said first and second cylinder rows.

14. An air/fuel supply system as claimed in claim 13, further comprising:

at least one reed valve for controlling the passage of air from each air intake passage to its corresponding cylinder row;

a reed valve holder assembly for each of said reed valves, each of said reed valve holder assemblies being substantially V-shaped in cross-section having first and second legs that converge toward the downstream direction of intake air flow, said first leg of said reed valve holder assembly being longer than said second leg and including an aperture therethrough, said at least one reed valve being secured to said first leg and extending over said aperture on the downstream side thereof, said at one fuel injector unit opening into the air intake passage on a side substantially opposing said first leg of said reed valve holder assembly such that fuel is sprayed by said fuel injector unit toward said first leg.

15. An air/fuel supply system as claimed in claim 14, wherein said reed valve holder assemblies are angled toward the crankshaft with said second leg of each of said reed valve holder assemblies being located closer to the crankshaft then said first leg.

16. An air/fuel supply system as claimed in claim 14, wherein said reed valve holder assemblies are angled away from the crankshaft with said first leg of each of said reed valve holder assemblies being located closer to the crankshaft than said second leg.

17. An air/fuel supply system as claimed in claim 14, wherein each of said reed valve holder assemblies include annular flanges for securing said reed valve holder assemblies to the crankcase.

18. A method for separately controlling the air/fuel supply mixture supplied to each cylinder row in a V-type two-cycle engine having first and second cylinder rows interconnected by a crankcase, first and second air intake passages having throttle valves and fuel supply units for supplying an air/fuel supply mixture into the first and second cylinder rows respectively, and a crankshaft rotatably mounted within a crank chamber open to said intake passages, said method comprising:

(a) sensing the rotational velocity of the crankshaft;
(b) sensing the degree of opening of each of the throttle valves;
(c) sensing the air intake pressure in each of the air intake passages;
(d) sensing the position of the crankshaft;
(e) determining the opening time of the fuel supply units for each cylinder row based on the sensed values in steps (a–c);
(f) determining the timing for the opening of one of the fuel supply units based on the sensed value in step (d) for a first cylinder;
(g) determining whether the first cylinder is located in the first cylinder row or the second cylinder row;
(h) assigning an opening time to the fuel supply unit as calculated in step (e) and an opening timing as calculated in step (f); and
(i) repeating steps (e–h) for each cylinder of the engine.

* * * * *